United States Patent [19]

D'Aurora et al.

[11] 4,369,973

[45] Jan. 25, 1983

[54] ELECTRONIC CROSSWORD PUZZLE

[76] Inventors: Joseph R. D'Aurora; David F. Specht, both of 5936 Stumph Rd., Apt. 319, Parma, Ohio 44130

[21] Appl. No.: 208,941

[22] Filed: Nov. 21, 1980

[51] Int. Cl.[3] ..... A63F 9/06

[52] U.S. Cl. ..... 273/153 R

[58] Field of Search ..... 273/1 GC, 1 E, 138, 273/153 R, 237, DIG. 28, 85 G; 364/410; 340/323 R

[56] References Cited

U.S. PATENT DOCUMENTS

| | | | |
|---|---|---|---|
| 3,787,988 | 1/1974 | Nakajima et al. | 434/201 |
| 3,863,931 | 2/1975 | Forsyth et al. | 273/237 |
| 4,026,555 | 5/1977 | Kirschner et al. | 273/85 G |
| 4,059,272 | 11/1977 | Pullman | 273/237 |
| 4,126,851 | 11/1978 | Okor | 273/85 G |
| 4,156,928 | 5/1979 | Inose et al. | 273/DIG. 28 |
| 4,160,242 | 7/1979 | Fowler et al. | 434/179 |
| 4,244,635 | 1/1981 | Sasaki et al. | 273/237 |
| 4,279,421 | 7/1981 | Tepoorten | 273/237 |

*Primary Examiner*—Vance Y. Hum

*Attorney, Agent, or Firm*—Watts, Hoffmann, Fisher & Heinke Co.

[57] ABSTRACT

A portable, electronic crossword puzzle device containing a plurality of crossword puzzle formats is disclosed. The device utilizes a central processing unit (46), a puzzle memory (50) having the puzzle formats contained therein, and a random access memory (52) for the storing of the answers to the puzzle format being solved. The puzzle questions and the answers chosen thereto are displayed by liquid crystal devices comprising a question panel display (18) and a matrix panel display (16), respectively. An indexable cursor or position indicator (70) is provided to indicate to the operator the location on the matrix panel display (16) being addressed. Provisions are included for changing an answer entered into the device, comparing an individual answer with the correct answer, and for determining the correct answer when it is not known by the operator thereof.

1 Claim, 6 Drawing Figures

ELECTRONIC CROSSWORD PUZZLE

TECHNICAL FIELD

The present invention relates generally to an electronic crossword puzzle device, and more particularly to a portable electronic crossword puzzle device that includes a self-contained memory so that different puzzles can be solved.

BACKGROUND ART

Electronic toys and games have become extremely popular recently primarily because of their relatively low cost. This low cost is directly attributable to the "state of the art" electronics, i.e., integrated circuits, etc., which are presently available. However, this state of the art electronics has been applied generally only to games and toys, and to the inventors' knowledge has never been applied to crossword puzzles, which have always had a large group of followers. An electrical crossword puzzle was disclosed in U.S. Pat. No. 3,863,931, however, this device utilizes letter blocks which are insertable into word squares on a game board. If the proper letter block has been chosen, electrical contact is made therethrough with the game board. The device disclosed in the foregoing patent differs from the invention of this disclosure in that the device utilizes electrical rather than electronic components, is not programmable, and does not have a memory.

Because of the popularity of crossword puzzles and the lack of any type of electronic crossword puzzle devices, it has become desirable to develop a portable, inexpensive, electronic crossword puzzle device which has a number of puzzle programs contained therein so that the operator thereof can choose any one of a number of puzzles to solve.

SUMMARY OF THE INVENTION

The present invention solves the aforementioned problems associated with the prior art as well as other problems by providing a portable, inexpensive electronic crossword puzzle device which includes programs for different types of crossword puzzles. The device includes a central processing unit which controls and synchronizes the operation of the entire device, a puzzle memory (ROM) which contains the puzzles to be solved, and a random access memory (RAM) for the storage of the answers selected by the person solving the puzzle. The questions to be solved are shown as a liquid crystal display, and the answer is "keyed" into the device on an alphabetic keyboard and is shown on a liquid crystal matrix panel display having a configuration similar to that of a crossword puzzle. An indexable cursor or position indicator is provided to show the operator of the puzzle his location in the matrix panel display. Means for correcting an answer already entered into the device, as well as means for comparing an individual answer with the correct answer and means for determining the correct answer are also provided to assist the operator of the device.

In view of the foregoing, it will be seen that one aspect of the present invention is to provide a portable, inexpensive electronic crossword puzzle device that utilizes a self-contained memory so that a plurality of puzzles and puzzle formats can be presented to and solved by the operator thereof.

Another aspect of the present invention is to provide an electronic crossword puzzle device that uses liquid crystal display means for both the puzzle question and the answer chosen to the question.

A still another aspect of the present invention is to provide an electronic crossword puzzle device which includes means for correcting answers that have already been entered therein.

A further aspect of the present invention is to provide an electronic crossword puzzle device which includes means for comparing individual answers with the correct puzzle answer and means for determining the correct puzzle answer when it is not known to the operator thereof.

A still further aspect of the present invention is to provide an electronic crossword puzzle device which includes means for indicating to the operator thereof the location in the puzzle matrix presently being addressed.

These and other aspects of the present invention will be more clearly understood after a review of the following description of the preferred embodiment when considered with the following drawings.

DESCRIPTION OF THE PREFERRED EMBODIMENT

Figure 1:
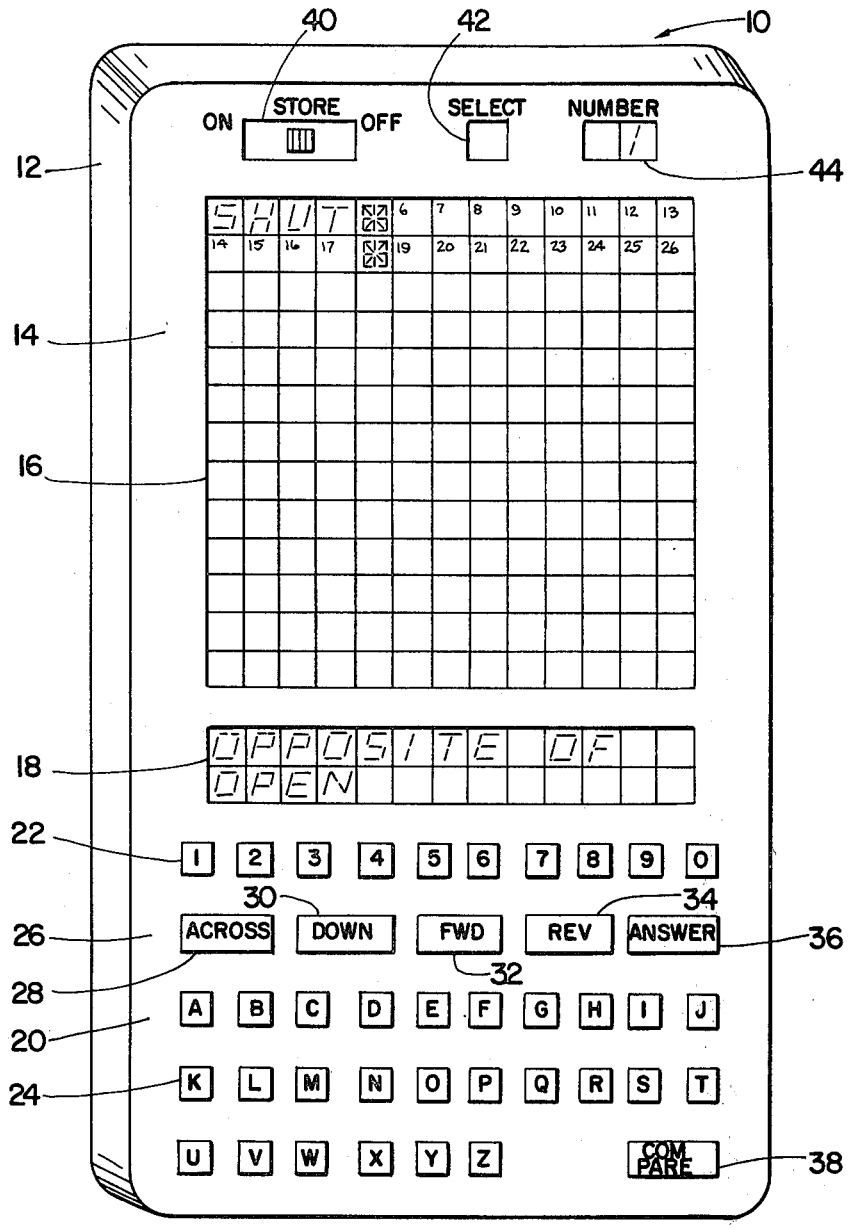
FIG. 1 is a front plan view of the electronic crossword puzzle device constructed in accordance with the present invention.

Referring now to the drawings where the illustrations are for the purpose of describing the preferred embodiment of the invention and are not intended to limit the invention hereto, FIG. 1 is a front plan view of a portable electronic crossword puzzle device 10 constructed in accordance with the present invention. The device 10 is comprised of a case 12 having a face 14 which is divided generally into a matrix panel display portion 16, a question panel display portion 18, and a keyboard portion 20. The keyboard portion 20 is further comprised of a numeric keyboard 22 representing the arabic numbers 0 through 9, an alphabetic keyboard 24, and a command push button keyboard 26. The command push button keyboard 26 is comprised of an across push button 28, a down push button 30, a forward push button 32, a reverse push button 34, an answer push button 36, and a compare push button 38. In addition, at the top of the face 14 of the case 12, adjacent the matrix panel display 16, are an on-store-off three position slide switch 40, a select push button 42, and a puzzle number display panel 44. The display panels comprising the matrix panel portion 16, the question panel portion 18 and the puzzle number display 44 are visual display devices, and are preferably liquid crystal displays. The function and operation of all of the foregoing components is hereinafter described.

Figure 2:
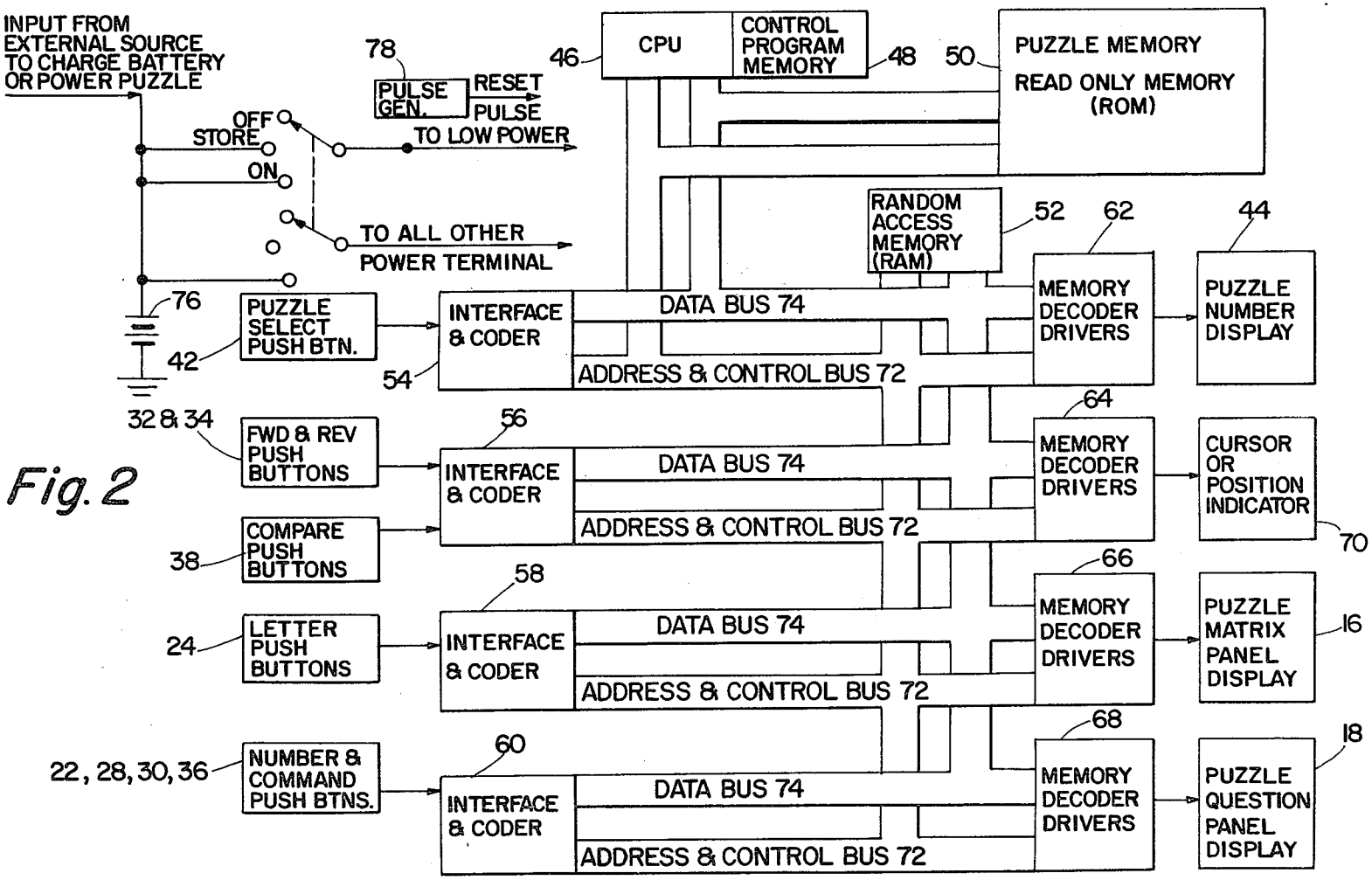
FIG. 2 is a schematic drawing of the circuit utilized by the present invention.

A block diagram of the control circuitry for this crossword puzzle device 10 is illustrated in FIG. 2. This control circuitry includes a central processing unit 46 having a control program memory 48 associated therewith, a read only memory (ROM) 50, a random access memory (RAM) 52, a plurality of interface and coding devices 54, 56, 58, 60 and a plurality of memory decoder drivers 62, 64, 66, 68. The interface and coding devices 54 through 60 are used as an input interface between the keyboard and command push buttons with the central processing unit 46. As such, interface and coding device 54 is associated with puzzle select push button 42; interface and coding device 56 is associated with forward push button 32, reverse push button 34, and compare push button 38; interface and coding device 58 is associated with the letter keys forming the alphabetic keyboard 24; and interface and coding device 60 is associated with the number keys forming the numeric keyboard 22, the across push button 28, the down push button 30, and the answer push button 36. In contrast, the memory decoder devices 62 through 68 are used as an output interface between the central processing unit 46 and the display devices. As such, memory decoder driver 62 is associated with the puzzle number display panel 44; memory decoder driver 64 is associated with a cursor or position indicator 70, hereinafter described; memory decoder driver 66 is associated with the matrix panel display 16; and memory decoder driver 68 is associated with question panel display 18. A common address and control bus 72 and a separate common data bus 74 are used to interconnect the central processing unit 46 with the interface and coding devices 54 through 60, the memory decoder drivers 62 through 68, the read only memory (ROM) 50, and the random access memory (RAM) 52.

The central processing unit 46 controls the flow of all information throughout the entire system under the direction of the control program memory 48. The control program memory 48 typically is contained in the central processing unit 46 but may be separate therefrom if the central processing unit 46 does not contain enough memory capacity.

Figures 3, 4A:
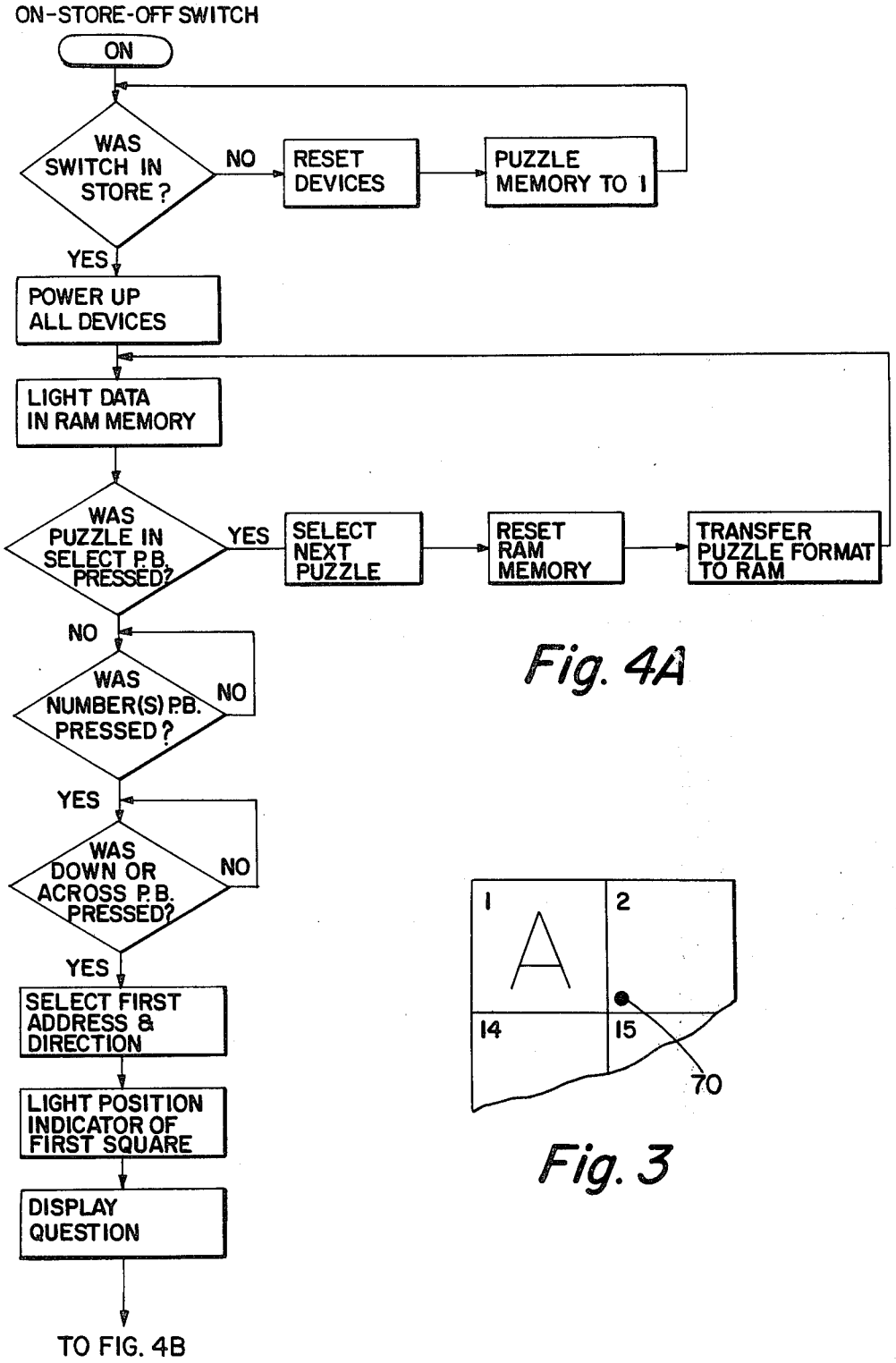
FIG. 3 is a partial cross-sectional view of the matrix panel display illustrating the cursor or position indicator.
FIGS. 4A through 4C illustrate a flow diagram of the logic steps utilized by the present invention during the operation thereof.
Figure 4B:
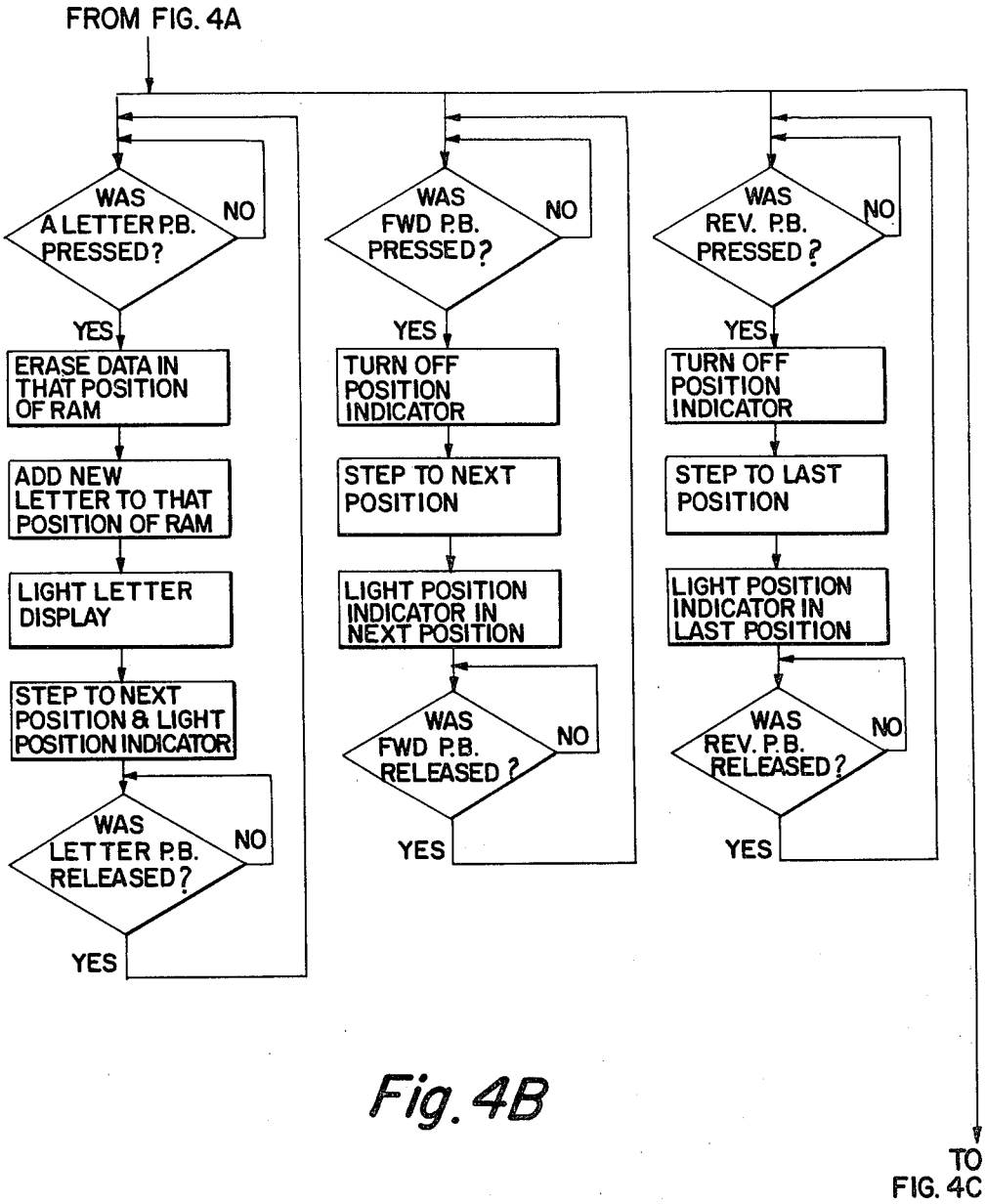
Figure 4C:
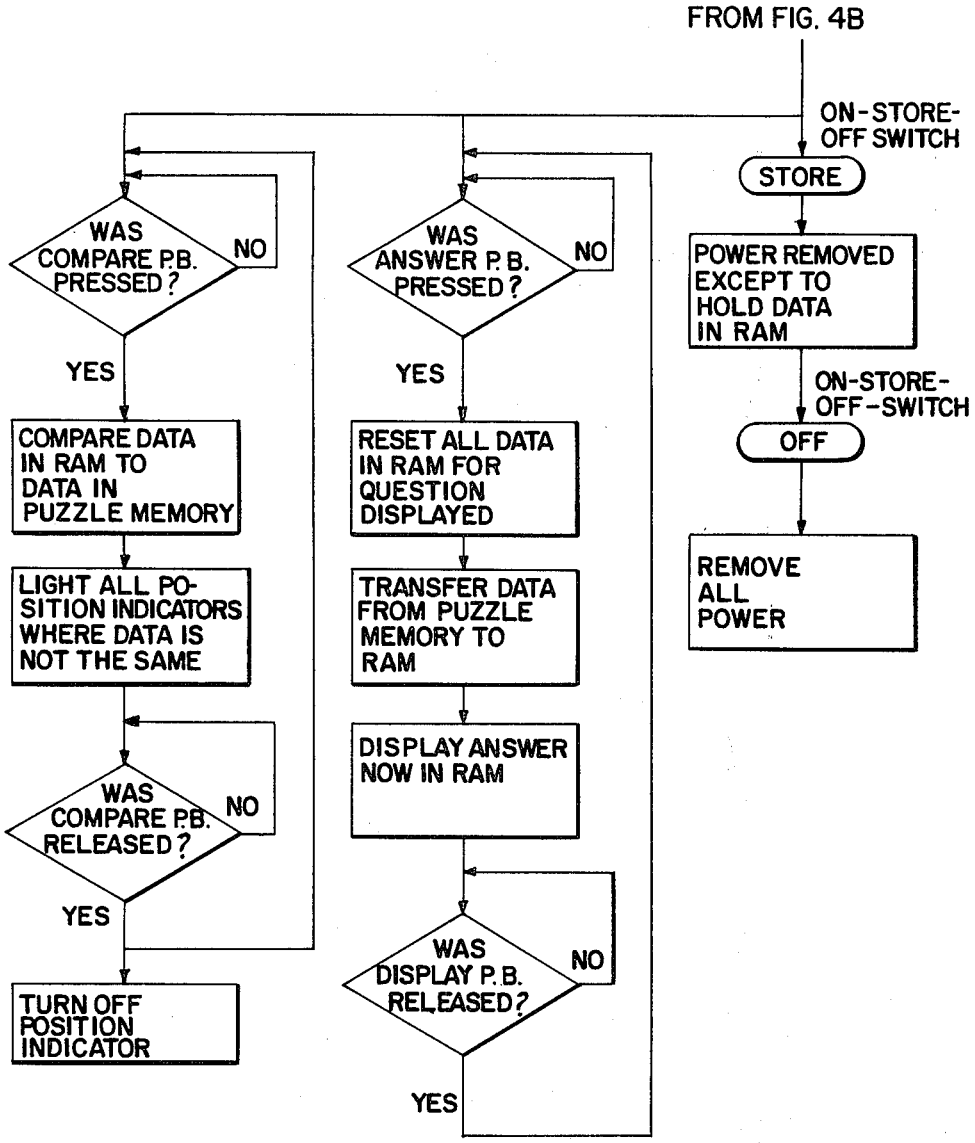

With respect to the operation of the device, the logic steps utilized are illustrated in flow diagram form in FIGS. 4A through 4C. Even though specific reference will not be made to this diagram in the following description of the operation of this device, periodic reference to this diagram may prove to be helpful to the reader hereof. In order to operate the device, the off-on-store slide switch 40 is moved from the "off" position to the "store" position which causes power to be supplied to the device 10 from either a battery 76 or some external power source and which causes a pulse generator 78 to generate a reset pulse. This pulse is applied to the central processing unit 46 and causes the central processing unit 46 to clear any data remaining in the RAM 52 and in the memory decoder drivers 62 through 68 over the common data bus 74. If the slide switch 40 is now moved from the "store" position to the "on" position, power is applied to all apparatus terminals. If the puzzle select push button 42 is now depressed, the interface and coding device 54 accesses the central processing unit 46 over the address and control bus 72 and a signal is transmitted thereto via the data bus 74. The central processing unit 46 identifies the address, i.e., the puzzle select push button 42, and through its control program memory 48 accesses the puzzle memory 50 over the address and control bus 72. The puzzle memory 50, in turn, transfers data as to the puzzle number and format over the data bus 74 to memory decoder drivers 62, 66 via the central processing unit 46 and the RAM 52. The memory decoder drivers 62, 66, in turn, cause the game number to be displayed on the puzzle number display panel 44 and cause the format, i.e., pattern of answer blocks to be displayed on the matrix panel display 16. The device 10 is now ready for presentation of questions to the operator thereof.

To obtain a question from the puzzle memory 50, which is replaceable to increase the number of puzzles available for selection, a number key in the numeric keyboard 22 and either the across push button 28 or the down push button 30 are depressed which causes the interface and coding device 60 to access the central processing unit 46 via the address and control bus 72 for the transmission of data thereto over the data bus 74. The central processing unit 46, under the instruction of the control program memory 48, then accesses the puzzle memory 50 over the address and control bus 72. The puzzle memory 50 forwards the question relating to the desired number and command over the data bus 74 to the memory decoder driver 68 via the central processing unit 46 and the RAM 52. The memory decoder driver 68, in turn, causes the question to be displayed on the question panel display 18. While this is occurring the central processing unit 46 also cause the cursor or position indicator 70 to light in the space provided in the matrix panel display 16 for the first letter of the answer to the question (See FIG. 3). The operator then reads the question in the question panel display 18, formulates an answer, and enters the answer in the device by depressing the proper push buttons in the alphabetic keyboard 24. This operation causes the interface and coding device 58 to access the central processing unit 46 via the address and control bus 72 and transmit data thereto over the data bus 74. The central processing unit 46, under the instruction of the control program memory 48, then forwards the data (i.e., the answer) over the data bus 74 to the RAM 52, where it is stored. The RAM 52, in turn, transmits the answer to the memory decoder device 66 which causes it to be sequentially printed, letter by letter, on the matrix panel display 16. The central processing unit 46, under the direction of the control program memory 48, also causes the cursor or position indicator 70 to index across the matrix panel display 16 as the answer is "keyed" into the device in order to provide an indication to the operator of the position of the next letter in the word chosen for the answer. The foregoing operation is employed to answer all of the questions in the crossword puzzle.

If the word selected as an answer has already been partially completed because of previously completed words, the operator can press the forward push button 32 which causes the interface and coding device 56 to access the central processing unit 46 via the address and control bus 72 and transmit a signal thereto over the data bus 74. The central processing unit 46, under the instruction of the control program memory 48, then causes a forward indexing pulse to be transmitted over the data bus 74 to the memory decoder driver 64 which, in turn, causes the cursor or position indicator 70 to be indexed one location forward for each actuation of the forward push button 32. In this manner, letters in a partially completed answer can be "skipped", and only those letters, as indicated by the cursor or position indicator 70, which are still blank need be entered by the operator.

In order to change an answer that has already been entered into the device, the key for the first number in the answer and either the across push button 28 or the down push button 30 are depressed which causes the proper question to appear on the question panel display 18, as previously described, and also causes the cursor or position indicator 70 to light in the space provided in the first letter of the answer to be changed. The new word is then entered by depressing the proper push buttons in the alphabetic keyboard 24. This operation causes the central processing unit 46 to replace the previous answer stored in the RAM 52 with the new answer and also causes the new answer to replace the previous answer shown on the matrix display 16. If only certain letters in an answer require changing, the forward push button 32 can be depressed which causes the cursor or position indicator 70 to index forward until it appears adjacent the letter to be changed at which time the new letter can be entered by depressing the proper key in the alphabetic keyboard 24. When so depressed, the central processing unit 46 replaces the previous letter stored in the RAM 52 with the new letter and also causes the new letter to replace the previous letter displayed on the matrix panel display 16.

A reverse push button 34 is also provided to assist in the changing of an answer already entered in the device. As in the case of the forward push button 32, actuation of the reverse push button 34 causes the interface and coding device 56 to access the central processing unit 46 via the address and control bus 72 and transmit a signal thereto over the data bus 74. The central processing unit 46 then causes a reverse indexing pulse to be transmitted over the data bus 74 to the memory decoder driver 64 which, in turn, causes the cursor or position indicator 70 to be indexed one location in the reverse direction for each actuation of the reverse push button 34. After the reverse push button 34 has been actuated and the cursor or position indicator 70 is adjacent the letter to be changed, the new letter can be entered by depressing the proper key in the alphabetic keyboard 24. This operation causes the new letter to replace the previous letter stored in the RAM 52 and displayed on the matrix display panel 16.

In order to determine if any answers are erroneous, the operator depresses the compare push button 38 which causes the interface and coding device 56 to access the central processing unit 46 via the address the control bus 72 and transmit a signal thereto over the data bus 74. The central processing unit 46, under the instruction of the control program memory 48, then causes an exclusive "OR" function to commence and compares the answers in the RAM 52, in sequence, with the answers in the puzzle memory 50. If the central processing unit 46 determines that certain letters in the RAM 52 are different from the corresponding letters in the puzzle memory 50, it sends a signal over the data bus 74 to the memory decoder driver 64 and lights the cursor or position indicator 70 adjacent those letters indicating to the operator which answers are incorrect. As soon as the compare push button 38 is released, those cursor or position indicators 70 lit indicating incorrect letters are extinguished and the device 10 reverts to its regular mode of operation.

To obtain the answer to a specific puzzle question, the operator depresses the key for the first number in the answer desired and either the across push button 28 or the down push button 30, depending on whether the answer is horizontal or vertical, which results in the question appearing on the question panel display 18, as previously described. The answer push button 36 is then depressed which causes the interface and coding device 60 to access the central processing unit 46 via the address and control bus 72 and transmit a signal thereto over the data bus 74. The central processing unit 46, under the instruction of the control program memory 48, then transfers the proper answer from the puzzle memory 50 over the data bus 74 to the RAM 52 where it replaces any previous answer which might be present for the question. The RAM 52, in turn, transmits the correct answer to the memory decoder driver 66 which causes it to be displayed on the matrix panel display 16.

The operator can stop working on the puzzle for a period of time without "losing" the answers that have already been placed in the RAM 52 by moving the off-on-store slide switch 40 from the "on" position to the "store" position. This "powers down" the device but retains power on all low power terminals so that the contents of the memories will be retained. This also substantially reduces the load on the battery 76 or other power sources utilized. The device 10 can be subsequently re-activated by merely moving the slide switch 40 from the "store" position to the "on" position without the loss of any answers in the RAM 52. Movement of the slide switch 40 to the "off" position erases all of the answers in the RAM 52 and permits the operator to select another puzzle from the puzzle memory 50 to answer using the foregoing operational procedure.

Certain modifications and improvements will occur to those skilled in the art upon reading the foregoing. It should be understood that all such modifications and improvements have been deleted herein for the sake of conciseness and readability but are property within the scope of the following claims.

We claim:

1. An electronic crossword puzzle apparatus comprising:

a central processing unit;

first memory means operatively coupled to said central processing unit for storing a crossword puzzle format;

puzzle display means operatively coupled to said central processing unit for displaying in matrix from said crossword puzzle format, certain individual locations in said format each being assigned a code designation;

addressing means operatively coupled to said central processing unit for addressing a particular word space to be solved in said crossword puzzle format, said addressing means including means to enter a code designation representing an individual matrix location and means to enter down or across commands into said central processing unit to define said word space to be solved;

position indication means operatively coupled to said central processing unit responsive to said addressing means for indicating on said puzzle display means a particular location addressed by said addressing means;

question display means operatively coupled to said central processing unit for automatically displaying a question associated with said addressed word space to be solved;

answer entering means operatively coupled to said central processing unit for entering an answer from a player in response to a question, a player's answer being displayed on said puzzle display means, said puzzle display means being adapted to display a players answer for each addressed word space being solved;

second memory means operatively coupled to said central processing unit for storing the player's answer for each word space location of said crossword puzzle format;

comparing means operatively coupled to said central processing unit for comparing the answers stored in said second memory means with correct answers for said crossword puzzle; and error indication means operatively coupled to said puzzle display means for indicating the correctness of answers provided by a player;

said answer entering means permitting a player to write over a part of or an entire answer for a word space location which said error indication means indicated an incorrect answer.

* * * * *